US005329862A

United States Patent [19]

Breezer et al.

[11] Patent Number: 5,329,862

[45] Date of Patent: Jul. 19, 1994

[54] HOISTING PALLET

[75] Inventors: Harlon W. Breezer, Portage; Thomas M. Pintar, Coloma; Michael J. Wolfe, Pardeeville, all of Wis.

[73] Assignee: Penda Corporation, Portage, Wis.

[21] Appl. No.: 38,526

[22] Filed: Mar. 29, 1993

[51] Int. Cl.[5] ..... B65D 19/00

[52] U.S. Cl. ..... 108/55.5; 108/901

[58] Field of Search ..... 108/51.1, 55.1, 55.3, 108/55.5, 56.1, 56.3, 901, 902

[56] References Cited

U.S. PATENT DOCUMENTS

| | | | |
|---|---|---|---|
| 2,611,569 | 9/1952 | Coleman et al. | 108/56.3 X |
| 3,277,847 | 10/1966 | Jensen . | |
| 3,610,173 | 10/1971 | McIlwraith . | |
| 3,667,403 | 6/1972 | Angelbeck, Jr. . | |
| 3,685,461 | 8/1972 | Belcher | 108/901 X |
| 3,696,761 | 10/1972 | Brown . | |
| 4,735,154 | 9/1983 | Hemery . | |
| 4,805,777 | 2/1989 | Mandel | 108/55.1 X |
| 5,020,667 | 6/1991 | Bush | 108/51.1 X |
| 5,097,951 | 3/1992 | Pigott et al. | 108/901 X |
| 5,197,396 | 3/1993 | Breezer et al. | 108/56.3 |

*Primary Examiner*—Jose V. Chen

*Attorney, Agent, or Firm*—Lathrop & Clark

[57] ABSTRACT

A twin sheet thermoformed pallet upper deck has a reinforcing metal substrate and downwardly protruding detents which engage with a hoisting cable or strap. Notches are formed on the sides of the top deck and restrict the escape of the cable when the pallet is elevated. A twin sheet thermoformed, metal substrate reinforced, lower deck is bolted to the upper deck through injection molded plastic legs which have upper and lower protrusions which fit within semi-circular pockets located on the upper and lower decks. Fasteners extend through metal gusset plates welded to the upper and lower deck substrates to form a rigid and strong pallet.

13 Claims, 5 Drawing Sheets

HOISTING PALLET

FIELD OF THE INVENTION

The present invention relates to pallets in general and to pallets which may be supported hoisted on flexible cables in particular.

BACKGROUND OF THE INVENTION

Pallets are movable support structures which are commonly used when it is desired to transport or store raw materials or manufactured products in an assembly which is compact and conveniently accessible by transportation equipment such as lift trucks, hand trucks, and cranes. Palletized loads may make their way from the original manufacturer or shipper to the end user with a minimum of shifting of the shipped objects required.

Loads which are shipped by cargo freighter or container ship are conventionally brought into the ship's hold by a crane utilizing two or more flexible lifting cables. Pallets for use with a lifting cable crane must provide access for the cables beneath the pallet support surface as well as providing entry for the tines of a forklift in ground transportation.

Conventional wooden pallets may provide sufficient strength for such applications, but are subject to splintering, rusting of fasteners and, especially in humid environments, rot. Furthermore, wooden pallets have a limited life span and are difficult to recycle.

What is needed is a durable, convenient, and long-lived pallet for use in connection with a lifting cable crane which may be employed in humid and saltwater environments.

SUMMARY OF THE INVENTION

The hoisting pallet of the present invention has a twin sheet thermoformed upper deck with a reinforcing metal substrate and downwardly protruding detents which engage with a hoisting cable or strap. Notches are formed on the sides of the top deck and restrict the escape of the cable when the pallet is elevated. A twin sheet thermoformed, metal substrate reinforced, lower deck is bolted to the upper deck through injection molded plastic legs which have upper and lower protrusions which fit within semi-circular pockets located on the upper and lower decks. Fasteners extend through metal gusset plates welded to the upper and lower deck substrates to form a rigid and strong pallet.

It is an object of the present invention to provide a pallet which is effectively engaged with lifting straps when elevated yet which easily disengages from the straps when the load is relieved.

It is also an object of the present invention to provide a plastic pallet capable of sustaining large loads.

It is an additional object of the present invention to provide a durable plastic pallet.

It is another object of the present invention to provide a pallet which may be lifted on the sides exterior to the legs, as well as at intermediate locations interior to the legs.

Further objects, features and advantages of the present invention will become apparent from the following description when taken in conjunction with the accompanying drawings.

DESCRIPTION OF THE PREFERRED EMBODIMENT

Figure 1:
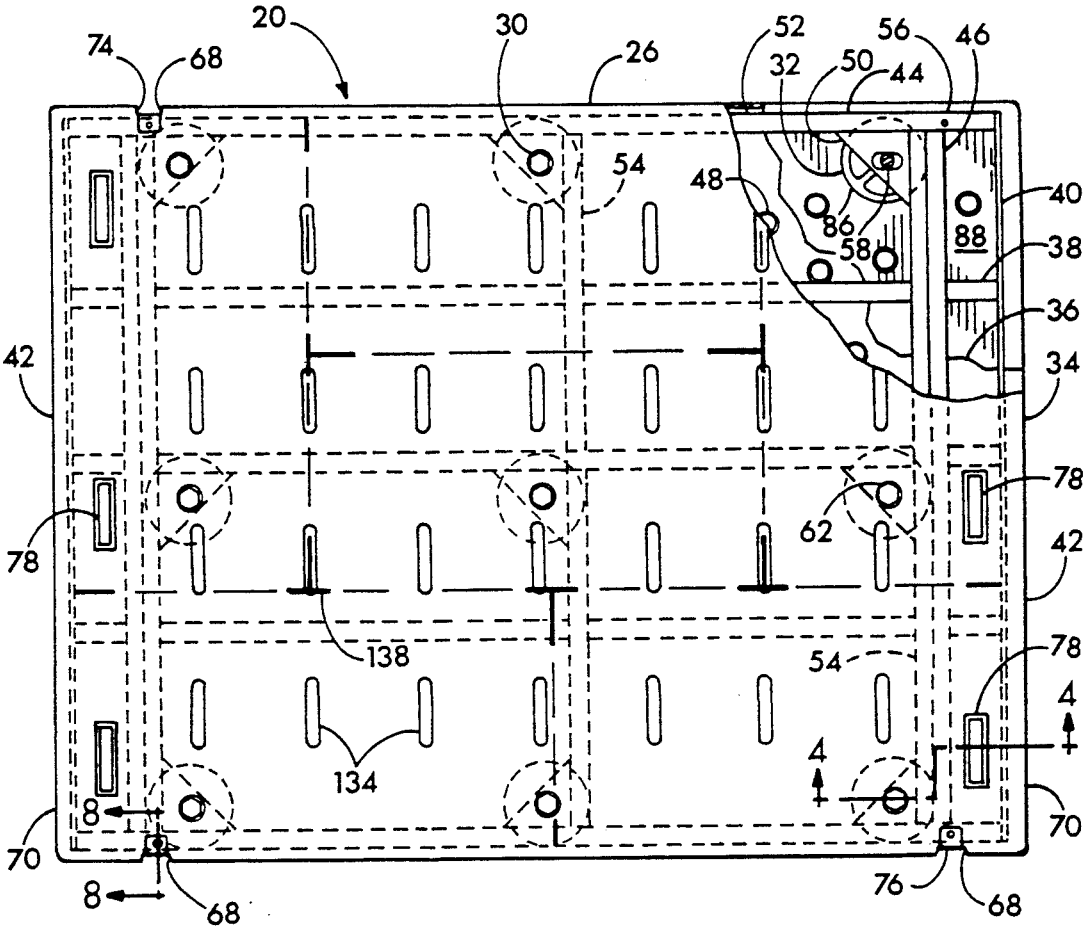
FIG. 1 is a top plan view of the lifting strap pallet of the present invention with portions broken away to disclose the reinforcing substrate.
Figure 2:
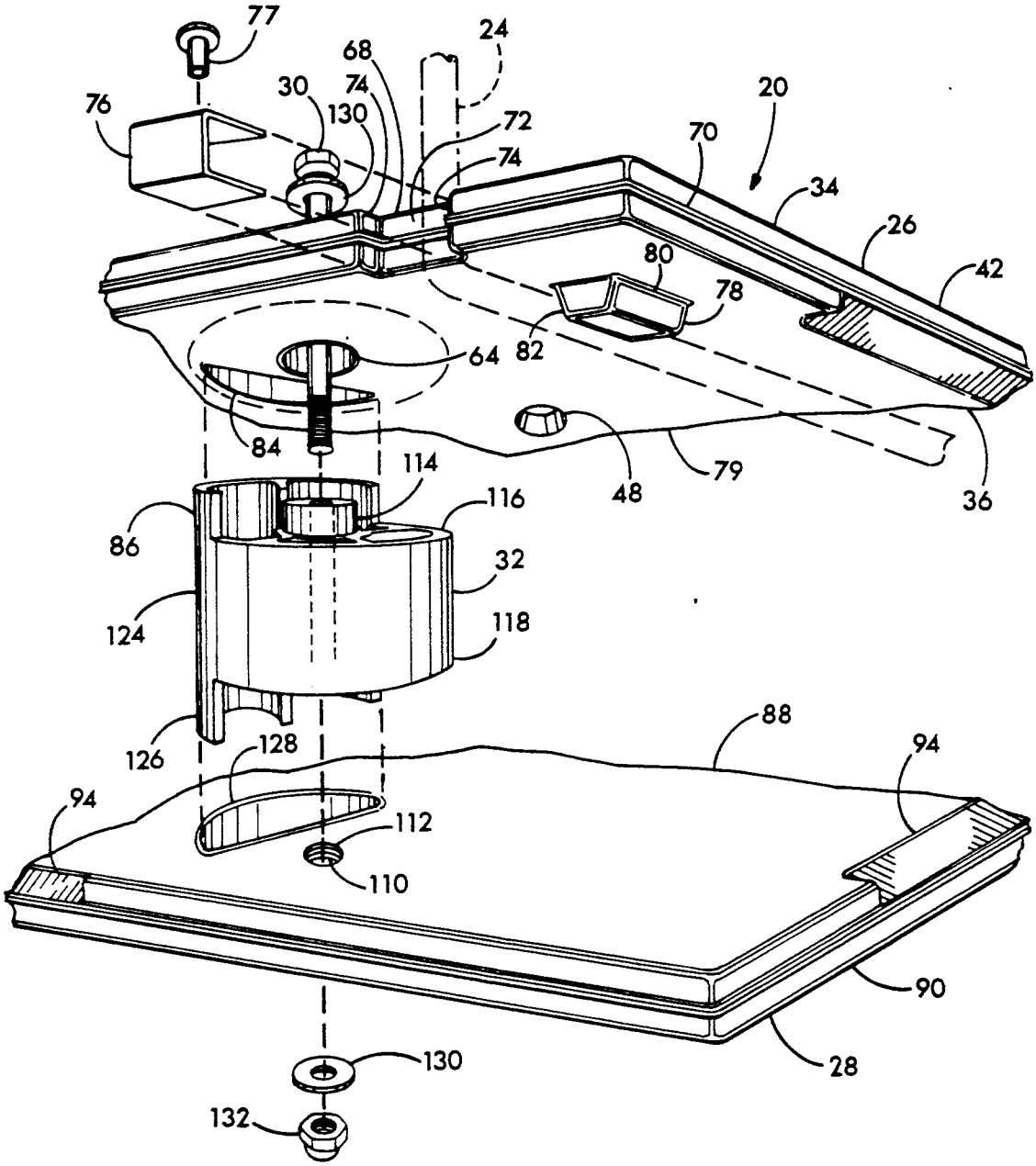
FIG. 2 is a fragmentary exploded perspective view of the pallet of FIG. 1.
Figure 3:
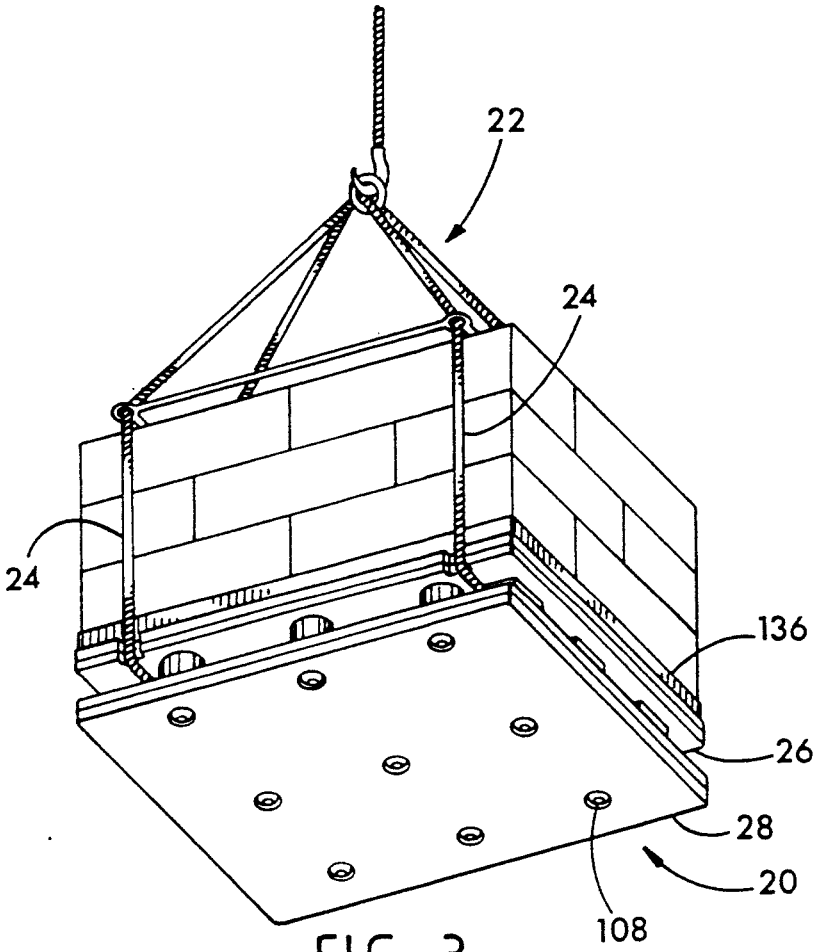
FIG. 3 is a bottom perspective view of the pallet of FIG. 1 with a restraining lip attachment elevated by a hoisting crane and supporting a load.

Referring more particularly to FIGS. 1–8, wherein like numbers refer to similar parts, a pallet 20 is shown in FIG. 1. The pallet 20 is particularly suited for transport by a hoisting apparatus 22 having two flexible lifting members 24 as shown in FIG. 3. The flexible lifting members will typically be high strength cable, such as $\frac{5}{8}''$ braided steel cable, although fabric straps or ropes of sufficient strength may be employed.

The pallet 20 of this invention is suitable for any sling lifting applications. The illustrated pallet 20 includes features which may be employed in a pallet for transporting bales of rubber.

As best shown in FIG. 3, the pallet 20 has a top deck 26 which is joined to a lower deck 28 by fasteners 30 which extend through nine cylindrical legs 32.

The top deck is preferably formed of high density polyethylene in a twin sheet thermoforming process. In the twin sheet thermoforming process an upper sheet 34 is heated and formed in an upper mold and pressed into engagement with a lower sheet 36 which has been formed in a lower mold. Portions of the upper sheet and lower sheet which are forced together in the molds are fused together at pinch points to form an integral continuous plastic part.

A rigid metal substrate 38, best shown in FIG. 1, is enclosed between the top deck upper sheet 34 and lower sheet 36. The substrate is preferably formed by $1''\times1''$ square steel tubing on the sides and interior of the top deck with $0.125''\times1''$ steel bar 40 at the lifting ends 42 of the pallet 20. The substrate 38 is formed as a regular rectangular grid of square steel tubing 44 welded together. For additional strength adjacent the lifting ends 42, double square tubing segments 46 are provided. The substrate 38 has portions of the tubing 44 which overlie the plastic posts and thus transfer downward loads on the pallet top deck to the posts.

To further stiffen the top deck 26 and fuse the upper sheet 34 to the lower sheet 36, an array of depressions 48 are formed on the lower sheet 36 and fused to the upper sheet 34 at a plurality of pinch points. The depressions 48 are positioned so as not to interfere with the substrate 38.

Figure 4:
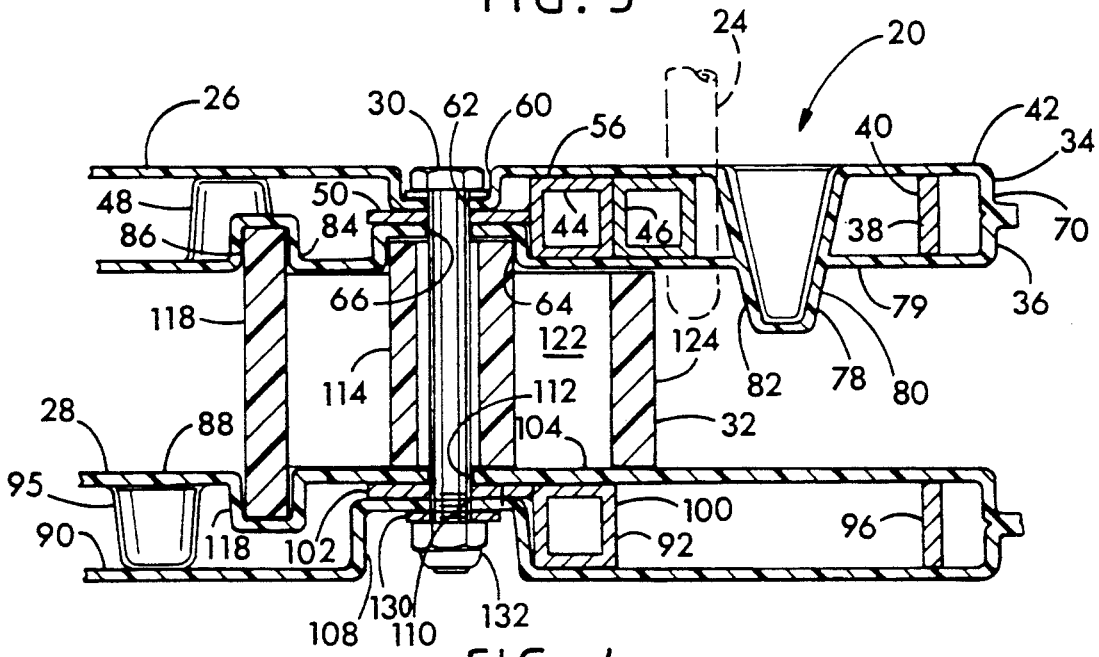
FIG. 4 is a cross-sectional view of the pallet of FIG. 1 taken along section line 4—4.

Triangular steel gusset plates 50 are welded between the outer square tubing segments which run between the lifting ends 42 and the tubing segments 54 which extend between the outer tubing segments 52. A gusset plate 50 is also welded at the center of the substrate 38. As best shown in FIG. 4, each gusset plate 50 is spaced approximately ½" below the upper surface 56 of the substrate 38. Each gusset plate 50 has an oblong slot 58 through which a fastener 30 extends to connect the top deck 26 to the pallet legs 32.

As best shown in FIG. 4, a cylindrical depression 60 is formed in the top deck upper sheet 34 above each gusset plate slot 58 and has a bolt hole 62 which extends through the upper sheet 34. Another cylindrical depression 64 is formed in the top deck lower sheet 36 immediately beneath the upper sheet depression 60. The lower sheet depression 64 engages against the gusset plate 50 and has a bolt hole 66 coaxial with and the same size as the bolt hole 62 in the upper sheet.

The top deck 26 is provided with structure which positions the flexible lifting member 24 for controlled elevation of the pallet and load and retains the member in position during shifting of the pallet 20. Two vertically extending notches 68 are formed by the fused upper and lower sheets 34, 36 of the top deck 26 and are set back approximately 3" from the exterior edge 70 of each lifting end 42. The notches 68 have a generally vertical bearing wall 72 and sidewalls 74 which extend outwardly from the vertical bearing wall 72. Each notch 68 serves to direct the lifting member 24 beneath the top deck 26 and is preferably provided with a metal clip 76 which overlies the vertical bearing wall 72 and which is attached by a rivet 77 to the upper sheet 34 and the substrate 38. The clip 76 covers the vertical bearing wall 72 and thus protects the plastic of the top deck 26 from abrasion and wear by the flexible hoisting member 24 which may be a somewhat abrasive steel cable. The sidewalls 74 of the notch 68 restrict the engaged lifting member 24 from forward or rearward movement within the notch 68.

The notches 68 direct the lifting member 24 beneath the pallet top deck to run along the lower sheet 36 of the top deck 26 along the lifting ends 42. Three downwardly extending detents 78 are located at each lifting end 42 of the top deck 26. As best shown in FIG. 4, each detent 78 has an inwardly ramped wall 80 and an outwardly ramped wall 82 which extend downwardly from the top deck lower sheet 36 lower surface 79. The walls 80, 82 of each strap detent 78 are formed by a fusion of the upper sheet 34 to the lower sheet 36. The outwardly ramped wall 82, which is located on the interior of each detent 78, directs an engaged lifting member 24 upwards and against the lower surface 79 of the pallet top deck 26. In the exemplary pallet 20, each detent is approximately two and a half inches wide and the walls 80, 82 are one half inch apart at the lowest portion of the detent 78.

The two notches 68 and three strap detents 78 located on each lifting end 42 cooperate to restrain a lifting member 24 which is carrying an elevated pallet 20 and prevent it from disengaging from the pallet. However, because the detents 78 do not extend the full distance between the top deck 26 and the bottom deck 28, when the pallet is supported as on a platform or a lift truck and the lifting straps are no longer in tension, the straps may be slipped beneath the detents 78 and conveniently disengaged from the pallet.

The lower sheet 36 of the top deck has semi-circular depressions 84 formed therein which receive upwardly protruding portions 86 of the posts 32. The depressions 84 define post pockets which provide positive engagement with the posts 32 and restrict the posts from rotating. The pockets 84 assure snug engagement between the top deck 26 and the posts.

The bottom deck 28 is also formed of high density polyethylene by a twin sheet thermoforming process. The bottom deck 28 has an upper thermoplastic sheet 88 which is fused to a lower thermoplastic sheet 90 to enclose a reinforcing metal substrate 92 between the two sheets. An array of depressions 95 extend downwardly from the bottom deck upper sheet 88 and are fused to the bottom deck lower sheet 90. Inclined entry ramps 94 are formed in the bottom deck upper sheet 88 between each pair of posts 32 and facilitate entry of forklift tines between the top and bottom deck 26, 28.

Figure 7:
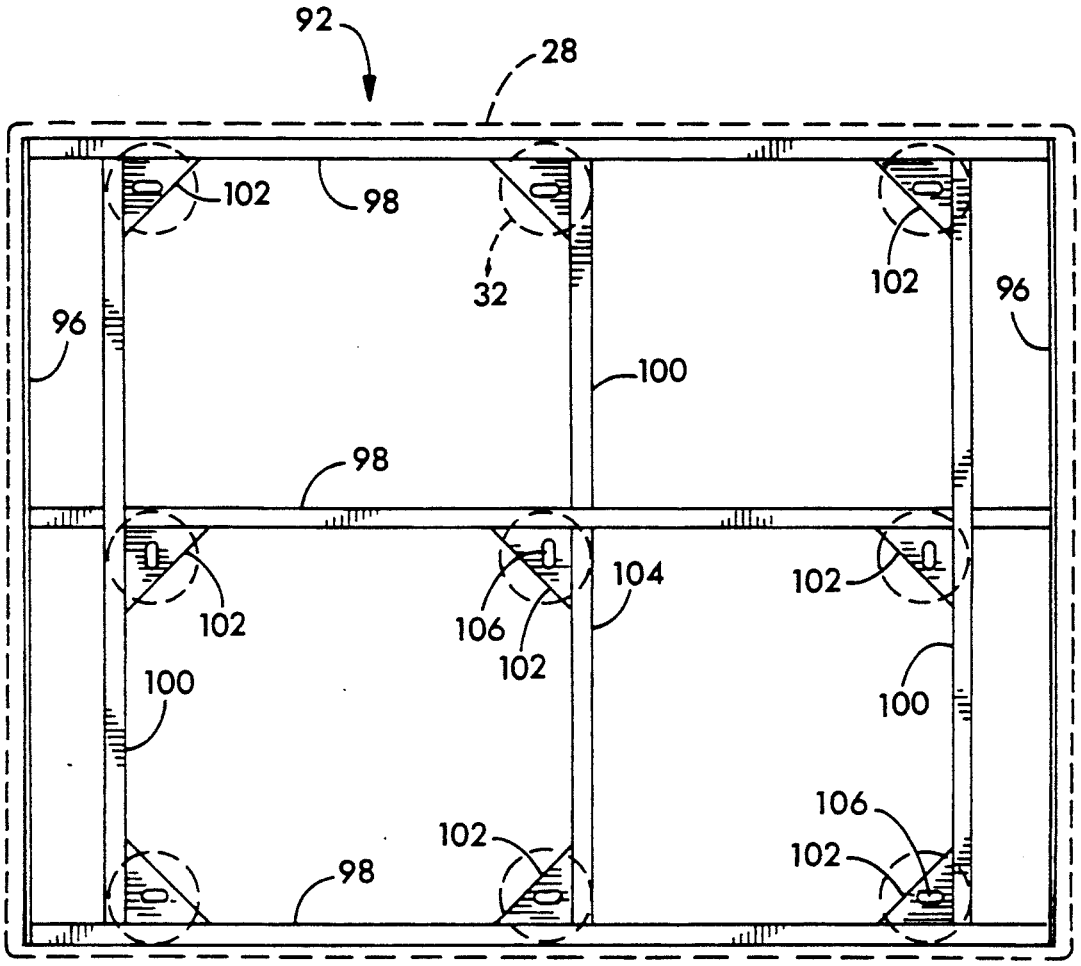
FIG. 7 is a top plan view of the bottom deck substrate of the pallet of FIG. 1, with the bottom deck shown in phantom view.

As shown in FIG. 7, the bottom deck substrate 92 is formed of 0.125"×1" steel bar stock segments 96 adjacent the lifting ends of the pallet and 1"×1" steel tubing segments 98 which extend between the bar stock segments and steel tubing segments 100 which extend between the ends perpendicular to the steel tubing segments 98. Portions of the bottom deck substrate extend beneath the posts 32 and hence carry loads from the posts to the substrate.

Triangular steel gusset plates 102 are welded between the steel tubing segments 100, 102 of the bottom deck substrate 92 and are substantially flush with the upper surface 104 of the substrate 92. Each gusset plate 102 has an oval slot 106 located beneath the corresponding slot 58 in the top deck gusset plate 50.

A fastener depression 108 extends upwardly from the bottom deck lower sheet 90 beneath each gusset plate 102 and has a bolt hole 110 which is aligned with the slots 106 and the bolt holes 62, 66 in the top deck 26. A bolt hole 112 is also formed in the bottom deck upper sheet 88 aligned with the lower sheet bolt hole 110, to receive the fastener 30 which extends through the top deck 26, a leg 32, and the bottom deck 28.

The bottom deck 28 is a substantially uninterrupted member which provides wide coverage and effective distribution of the pallet load onto a support surface.

Figure 5:
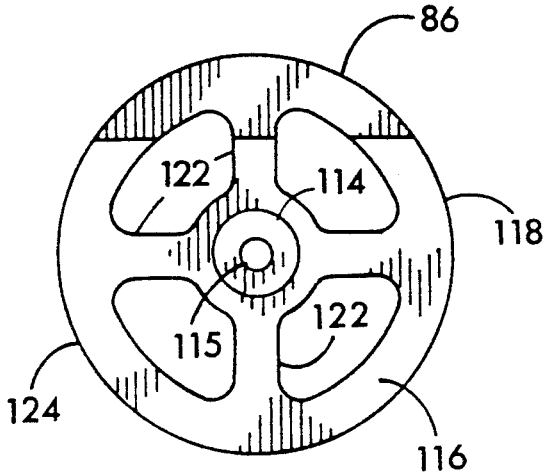
FIG. 5 is a top plan view of a post of the pallet of FIG. 1.
Figure 6:
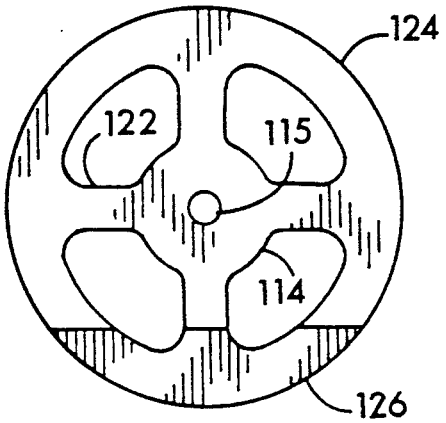
FIG. 6 is a bottom plan view of the post of FIG. 5.
Figure 8:
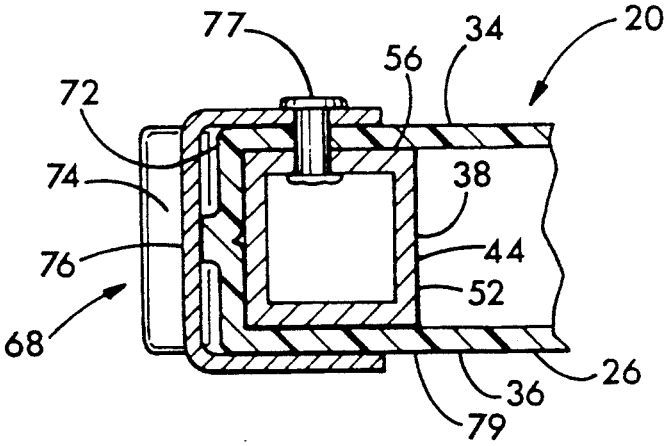
FIG. 8 is a fragmentary cross-sectional view of the pallet of FIG. 1 taken along section line 8—8.

The pallet legs or posts 32, as best shown in FIGS. 5 and 6, are formed of injection molded plastic and preferably have a wall thickness of approximately one half inch. Each post has a cylindrical exterior with a protruding bolt sleeve 114 which extends approximately one quarter inch above the top surface 116 of the post body 118. The bolt sleeve 114 defines a bolt hole 115 which extends through the post. A protruding portion 86 extends upwardly from the body 118 and is a semi-circular segment which engages with a depression 84 formed in the top deck. The protruding portion 86 serves to locate and orient the post with respect to the top deck and the top deck substrate 38. Furthermore, the protruding portion 86 restricts the post from rotating and hence avoid movements which might tend to unfasten the fasteners 30.

Four reinforcing webs 122 extend between an outer cylindrical wall 124 of the post 32 and the bolt sleeve 114.

A semi-circular lower protrusion 126 extends downwardly from the post body 118 directly beneath the upper protruding portion 86. The lower protrusion 126 engages with a semi-circular depression 128 in the upper sheet 88 of the bottom deck 28.

As best shown in FIGS. 1 and 4, the posts 32 are positioned such that the post body 118 directly underlies the tubing of the top deck substrate 38. In a like manner, the post body overlies tubing of the bottom deck substrate 92.

The fastener 30 is preferably a steel hex head bolt which is threaded to engage with a washer 130 on the top deck and a washer 130 and a nut 132 within the bottom deck fastener depression 108. The nut is preferably a NYLOC nut having a nylon core for secure engagement with the threaded steel bolt.

As best shown in FIG. 4, a rigid metal truss is formed between the gusset plates 50, 102, the substrates 38, 92 in the top and bottom decks, and the fasteners 30. This secure engagement between the metal parts of the pallet 20 is particularly advantageous when lifting heavy loads. For example, a pallet 20 may be stacked with bales of rubber three feet high or more, and, with stacking of one loaded pallet on another, a lower pallet may be expected to bear loads of 9,000 pounds or more.

Additional features which may be employed with the pallet 20 when required for transporting semi-flowable solids such as raw rubber, are shown in FIGS. 1 and 3. An array of gripping grooves 134 may be formed in the upper sheet 34 of the top deck 26. The grooves 134 provide a volume for flowable rubber to flow into and hence restrict rubber's flow off the pallet.

As shown in FIG. 1, grid-like indicia 138 may be molded into the upper sheet of the top deck to indicate appropriate placement of the first layer of rubber bales on the top deck.

Margin boards 136, preferably formed of aluminum, may be bolted to the upper deck of the pallet 20 as shown in FIG. 3. The margin boards act as a lip which restrains the base of the loaded rubber stack from flowing off the pallet.

It is important to note that the present invention is not limited to the particular construction and arrangement of parts disclosed and illustrated herein, but embraces all modified forms thereof as come within the scope of the following claims.

We claim:

1. A pallet comprising:

(a) a twin-sheet thermoformed top deck having a thermoplastic upper sheet which is fused to a thermoplastic lower sheet, wherein the top deck has a lower surface and two opposed ends;

(b) portions of the pallet top deck which define at least one downwardly protruding plastic detent on each of said two opposed ends of the top deck, wherein the detents have inwardly facing surfaces which extend from the top deck lower surface to engage against a flexible lifting member looped beneath the top deck to restrain outward motion of the member when the pallet is supported by the lifting member;

(c) a twin-sheet thermoformed bottom deck having a thermoplastic upper sheet which is fused to a thermoplastic lower sheet; and (d) a plurality of plastic posts which extend between and are fastened to the top deck and the bottom deck, wherein the posts are located inwardly from the top deck indents.

2. The pallet of claim 1 further comprising portions of the pallet top deck which define a notch on each side of the top deck between said two opposed ends, wherein the notches have a bearing wall which extends vertically and has outwardly extending sidewalls which restrict motion of a flexible lifting member engaged within the notch in a direction between said opposed ends.

3. The pallet of claim 2 further comprising a metal clip connected to the pallet top deck and extending into a notch, wherein the clip has portions which cover the bearing wall of said notch and protect said bearing wall from abrasion.

4. The pallet of claim 1 further comprising:

(a) a depression formed in the top deck lower sheet which defines a recessed pocket positioned above one of said plurality of posts,; and (b) portions of said one post which protrude upwardly into engagement with the top deck pocket to position said one post and restrict its motion.

5. The pallet of claim 1 further comprising:

(a) a metal substrate located in the top deck between the upper sheet and the lower sheet, the substrate having segments which are positioned above portions of the pallet posts;

(b) at least one metal plate which is connected to one of said substrate segments, wherein the metal plate is positioned above a pallet post, the plate having portions defining a bolt hole; and (c) a fastener which extends through the top deck upper sheet, through the metal plate bolt hole, through the top deck lower sheet, through the pallet post and through the bottom deck to engage the top deck to the bottom deck.

6. The pallet of claim 5 further comprising:

(a) a metal substrate located in the bottom deck between the bottom deck upper sheet and the bottom deck lower sheet, the substrate having segments which are positioned below portions of the pallet posts; and (b) at least one metal plate which is connected to a bottom deck metal substrate, wherein the metal plate is positioned below a pallet post, the plate having portions defining a bolt hole, wherein the fastener extends through the bottom deck upper sheet, the bottom deck plate, and the bottom deck lower sheet to engage the top deck to the bottom deck.

7. The pallet of claim 1 further comprising metal lips which are fastened to the top deck and which extend upwardly therefrom to restrict the movement off the pallet of material positioned on the top deck.

8. The pallet of claim 1 wherein the pallet top deck upper sheet defines an upper surface, and further comprising a plurality of grooves which extend beneath the level of the upper surface, the grooves being adapted to engage with a flowable material positioned on the upper surface to restrict motion of said material off the pallet.

9. A pallet comprising:

(a) a twin-sheet thermoformed top deck having a thermoplastic upper sheet which is fused to a thermoplastic lower sheet;

(b) a twin-sheet thermoformed bottom deck having a thermoplastic upper sheet which is fused to a thermoplastic lower sheet;

(c) a plurality of plastic posts which extend between and are fastened to the top deck and the bottom deck;

(d) a metal substrate located in the top deck between the upper sheet and the lower sheet, the substrate having segments which are positioned above and over portions of the pallet posts;

(e) at least one metal plate which is connected to one of said substrate segments, wherein the metal plate is positioned above and over a pallet post, the plate having portions defining a bolt hole; and (f) a fastener which extends through the top deck upper sheet, through the metal plate bolt hole, through the top deck lower sheet, through the pallet post and through the bottom deck to engage the top deck to the bottom deck.

10. The pallet of claim 9 further comprising:

(a) a metal substrate located in the bottom deck between the bottom deck upper sheet and the bottom deck lower sheet, the substrate having segments which are positioned beneath portions of the pallet posts; and (b) at least one metal plate which is connected to a bottom deck metal substrate which is positioned beneath a pallet post, the plate having portions defining a bolt hole, wherein the fastener extends through the bottom deck upper sheet, the bottom deck plate, and the bottom deck lower sheet to engage the top deck to the bottom deck.

11. A pallet comprising:

(a) a twin-sheet thermoformed top deck having a thermoplastic upper sheet which is fused to a thermoplastic lower sheet, wherein the top deck has a lower surface, and two opposed ends and two sides which extend between the ends;

(b) portions of the pallet top deck which define at least one downwardly protruding plastic detent on each of said two opposed ends of the top deck, wherein the detents have an inwardly facing surface which extends beneath the top deck lower surface to engage against a flexible lifting member looped beneath the top deck to restrain outward motion of the member when the pallet is supported by the lifting member;

(c) portions of the pallet top deck which define a a pair of notches proximate each of said opposed ends, wherein a notch is positioned on each of said top deck sides intermediate said opposed ends, and wherein each notch has a bearing wall which extends vertically and has outwardly extending sidewalls which restrict motion of a flexible lifting member engaged within a notch in a direction between said opposed ends;

(d) a bottom deck disposed beneath the top deck; and (e) a plurality of plastic posts which extend between and are fastened to the top deck and the bottom deck, wherein the posts are located inwardly from the top deck indents and notches.

12. The pallet of claim 11 further comprising a metal clip which is connected to the pallet top deck and which has portions which extend into a notch to cover the bearing wall of a notch and protect said bearing wall from abrasion.

13. The pallet of claim 11 wherein a plurality of detents are aligned along each opposed end.

* * * * *